US010361475B2

(12) United States Patent
Wu et al.

(10) Patent No.: US 10,361,475 B2
(45) Date of Patent: Jul. 23, 2019

(54) ANTENNA UNIT AND ANTENNA SYSTEM

(71) Applicant: PEGATRON CORPORATION, Taipei (TW)

(72) Inventors: Chien-Yi Wu, Taipei (TW); Chao-Hsu Wu, Taipei (TW); Ya-Jyun Li, Taipei (TW); Shih-Keng Huang, Taipei (TW); Chia-Chi Chang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 162 days.

(21) Appl. No.: 15/410,786

(22) Filed: Jan. 20, 2017

(65) Prior Publication Data

US 2017/0301978 A1 Oct. 19, 2017

(30) Foreign Application Priority Data

Apr. 15, 2016 (TW) ..... 105111886 A

(51) Int. Cl.

| | |
|---|---|
| ***H01Q 1/22*** | (2006.01) |
| ***H01Q 9/04*** | (2006.01) |
| ***H01Q 5/364*** | (2015.01) |
| ***H01Q 1/36*** | (2006.01) |
| ***H01Q 1/38*** | (2006.01) |
| ***H01Q 1/48*** | (2006.01) |
| ***H01Q 21/20*** | (2006.01) |

(52) U.S. Cl.

CPC ..... *H01Q 1/2291* (2013.01); *H01Q 1/36* (2013.01); *H01Q 1/38* (2013.01); *H01Q 1/48* (2013.01); *H01Q 5/364* (2015.01); *H01Q 9/0421* (2013.01); *H01Q 9/0457* (2013.01); *H01Q 21/205* (2013.01)

(58) Field of Classification Search

CPC ..... H01Q 1/38; H01Q 5/364; H01Q 9/0421; H01Q 9/0407; H01Q 21/065; H01Q 21/28; H01Q 25/001; H01Q 25/002; H01Q 9/0492; H01Q 21/24

See application file for complete search history.

(56) References Cited

U.S. PATENT DOCUMENTS

| | | | | |
|---|---|---|---|---|
| 4,379,296 | A * | 4/1983 | Farrar | H01Q 3/247 343/700 MS |
| 9,991,601 | B2 * | 6/2018 | McMichael | H01Q 9/0435 |
| 2004/0077379 | A1 * | 4/2004 | Smith | H01Q 1/246 455/562.1 |
| 2017/0250471 | A1 * | 8/2017 | Lee | H01Q 9/0407 |

FOREIGN PATENT DOCUMENTS

| | | | |
|---|---|---|---|
| CN | 200997448 | Y | 12/2007 |
| KR | 20140009740 | A | 1/2014 |
| TW | I496350 | B | 8/2015 |

* cited by examiner

*Primary Examiner* — Ricardo I Magallanes

(74) *Attorney, Agent, or Firm* — McClure, Qualey & Rodack, LLP

(57) ABSTRACT

An antenna unit includes a first metal portion, a second metal portion connected to one side of the first metal portion, a third metal portion connected to another side of the first metal portion and opposite to the second metal portion, a feed point disposed at the second metal portion, a first ground terminal, and a second ground terminal. The feed point, the first ground terminal and the second ground terminal are disposed in a straight line. The shape of the first metal portion is mirror-image symmetrical relative to the feed point, the first ground terminal and the second ground terminal.

18 Claims, 5 Drawing Sheets

ANTENNA UNIT AND ANTENNA SYSTEM

RELATED APPLICATIONS

This application claims priority to Taiwan Application Serial Number 105111886, filed Apr. 15, 2018, which is herein incorporated by reference.

BACKGROUND

Technical Field

The present disclosure relates to an antenna. More particularly, the present disclosure relates to a multi frequency antenna unit and multi-frequency antenna system.

Description of Related Art

Products like wireless broadband routers and wireless access points have been very popular nowadays. Most conventional wireless local area network or bridge antennas using 802.11a/b/g/n protocols have used a dipole antenna structure such as a multi-input multi-output (MIMO) antenna module having multiple loops, which has Wi-Fi 2.4G antennas and Wi-Fi 5G antennas disposed alternately. One of the common antenna radiation patterns is omnidirectional. When plural antennas are disposed in an array, their radiation patterns may interfere with each other.

SUMMARY

An aspect of the present disclosure is to provide an antenna unit. Antenna unit includes a first metal portion, a second metal portion connected to one side of the first metal portion, a third metal portion which is connected to another side of the first metal portion and is opposite to the second metal portion, a feed point disposed at the second metal portion, a first ground terminal and a second ground terminal. The feed point, the first ground terminal and the second ground terminal are disposed in a straight line. A shape of the first metal portion is mirror-image symmetrical relative to the feed point, the first ground terminal and the second ground terminal.

Another aspect of the present disclosure is to provide an antenna system. The antenna system includes an antenna array which includes antenna units. Each antenna unit has a directional antenna field. The antenna units are disposed around a center and the directional antenna field of each antenna unit extends outward from the center. Each antenna unit includes a first metal portion, a second metal portion connected to one side of the first metal portion, a third metal portion which is connected to another side of the first metal portion and is opposite to the second metal portion, a feed point disposed at the second metal portion, a first ground terminal, and a second ground terminal. The feed point, the first ground terminal and the second ground terminal are disposed in a straight line. A shape of the first metal portion is mirror-image symmetrical relative to the feed point, the first ground terminal and the second ground terminal.

DETAILED DESCRIPTION

Specific embodiments of the present invention are further described in detail below with reference to the accompanying drawings, however, the embodiments described are not intended to limit the present invention and it is not intended for the description of operation to limit the order of implementation. Moreover, any device with equivalent functions that is produced from a structure formed by a recombination of elements shall fall within the scope of the present invention. Additionally, the drawings are only illustrative and are not drawn to actual size. In accordance with the standard practice in the industry, various features are not drawn to scale. In fact, the dimensions of the various features may be arbitrarily increased or reduced for clarity of discussion.

Figure 1:
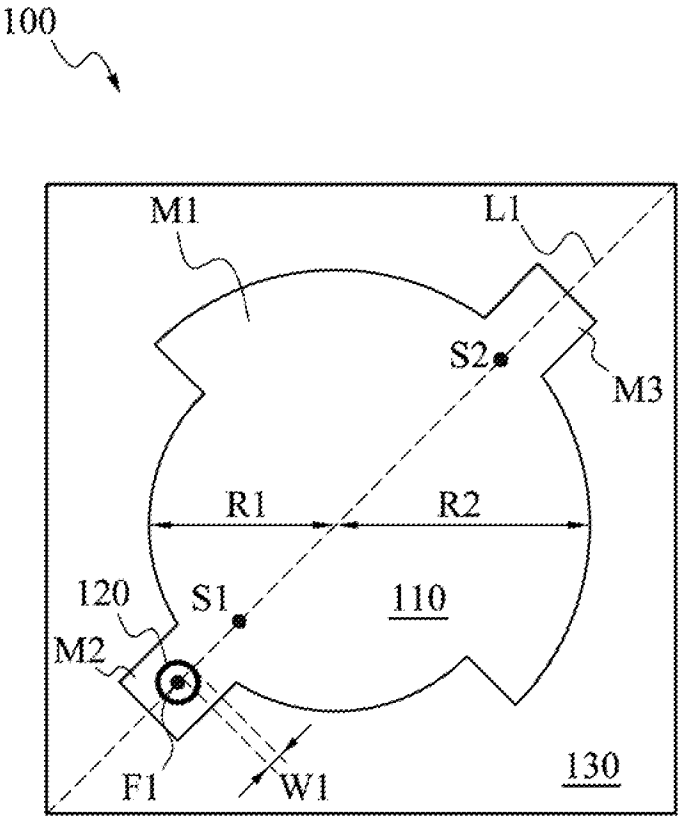
FIG. 1 is a schematic top view of an antenna unit according to an embodiment of this disclosure.

FIG. 1 depicts schematic top view of an antenna unit 100 according to an embodiment of this disclosure. As shown in the figure, the antenna unit 100 includes a metal component 110 and a first substrate 130. In one embodiment, the antenna unit 100 uses a flat antenna design. In some embodiments, the first substrate 130 can be a plastic substrate.

As shown in FIG. 1, the metal component 110 includes a first metal portion M1, a second metal portion M2 and a third metal portion M3. The first metal portion M1 is a main body of the metal component 110. In this embodiment, the first metal portion M1 has a symmetrical structure. In the example of FIG. 1, the first metal portion M1 consists of a semicircle with a radius R1 and another semicircle with a radius R2. In this example, the radius R1 is different from the radius R2, such that the first metal portion M1 forms the symmetrical shape as shown in FIG. 1. However, this disclosure is not limited thereto. In other embodiments, the radius R1 can be equal to the radius R2, such that the first metal portion M1 is substantially circular.

The second metal portion M2 and the third metal portion M3 are respectively connected to protruding portions at two sides of the first metal portion M1. Specifically, the second metal portion M2 is connected to one side of the first metal portion M1 (at the lower left of the first metal portion M1 depicted in FIG. 1). The third metal portion M3 is connected to another side of the first metal portion M1 (at the upper right of the first metal portion M1 depicted in FIG. 1). The position of the third metal portion M3 is opposite to the position of the second metal portion M2.

The second metal portion M2 includes a feed-in point F1. The first metal portion M1 includes a first ground terminal S1. The second ground terminal S2 is disposed at the third metal portion M3 or on the first metal portion M1 and near the third metal portion M3. It should be noted that the feed-in point F1, the first ground terminal S1 and the second ground terminal S2 are disposed in a straight line L1, and the shape of the metal component 110 (i.e., the first metal portion M1, the second metal portion M2 and the third metal portion M3) is mirror-image symmetrical relative to the straight line L1.

Figure 2:
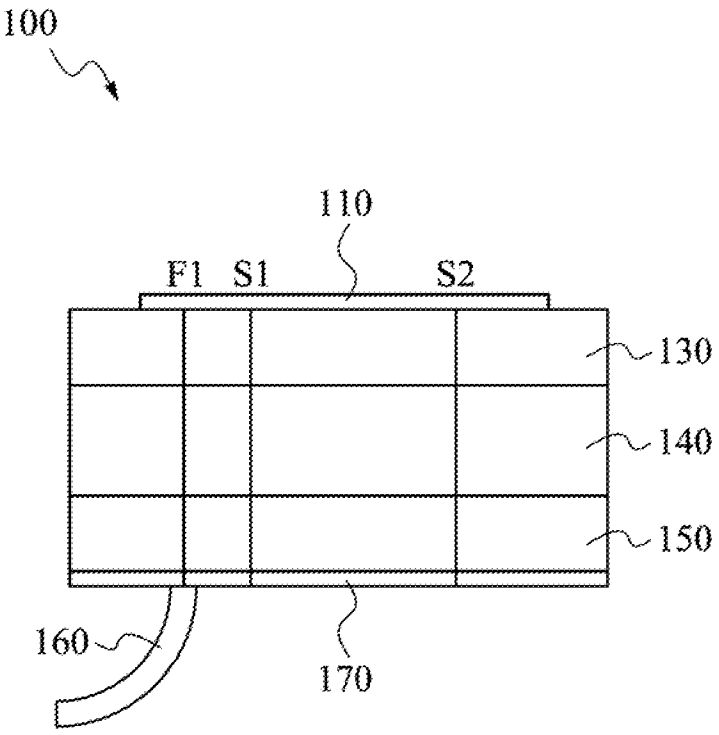
FIG. 2 is a schematic side view of an antenna unit according to another embodiment of this disclosure.

Also referring to FIG. 2. FIG. 2 depicts a schematic side view of the antenna unit 100 of FIG. 1. As shown in FIG. 2, the antenna unit 100 further includes a second substrate 140 and a third substrate 150. The first substrate 130 is used to support the metal component 110 of the main body of the antenna unit 100, and the bottom of the third substrate 150 is connected to a ground plane 170. In practical applications, the ground plane 170 can be a metal conductive plate used to generate coupling resonance with the metal component 110 of the antenna unit 100, which is the basic principle of communication of a patch antenna, and is not described in detail herein. The second substrate 140 is disposed between the first substrate 130 and the third substrate 150 as a dielectric substrate separating the metal component 110 and the ground plane 170.

A coaxial transmission line 160 includes a positive signal terminal and a negative signal terminal. A feed-in point F1 is electrically coupled to the positive signal terminal of the coaxial transmission line 160 to receive signals. A first ground terminal S1 and a second ground terminal S2 are electrically coupled to the ground plane 170, so as to be, connected to the negative signal terminal of the coaxial transmission line 160.

All of the first substrate 130, the second substrate 140 and the third substrate 150 can be plastic substrates. In the embodiment shown in FIG. 2, the first substrate 130, the second substrate 140 and the third substrate 150 are three independent substrates, such that they can be respectively manufactured conveniently by different processes and being assembled, but the present disclosure is not limited thereto. Further, because the antenna unit 100 includes the first substrate 130, the second substrate 140 and the third substrate 150, the total thickness of the substrates will cause higher inductance of the antenna. Accordingly, a slot structure 120 with a width W1 can be disposed surrounding the feed-in point F1 at a distance. By adjusting the distance between the slot structure 120 and the feed-in point F1 to change the inductance, the impedance matching of the antenna can be modified.

In another embodiment, the first substrate 130, the second substrate 140 and the third substrate 150 can be different parts of a single dielectric substrate integrally formed in one piece, and the metal component 110 and the ground plane 170 are respectively disposed at the two sides of the single dielectric substrate.

In practical applications, when the antenna unit 100 is a dual-frequency antenna with frequencies 2.4 GHz and 5 GHz, the lengths and widths of the first substrate 130, the second substrate 140 and the third substrate 150 are about 35 mm×35 mm while the thicknesses of them are 0.8 mm, 3.4 mm and 0.8 mm in sequence. That is, the total thickness of antenna is 5 mm. In this example, the radius R1 is about 10 mm, and the radius R2 is about 13 mm. When the second ground terminal S2 is coupled to the ground plane 170, the antenna unit 100 will resonate at 5 GHz frequency. When both the second ground terminal S2 and the first ground terminal S1 are coupled to the ground plane 170 the antenna unit 100 will resonate at 2.4 GHz frequency and 5 GHz frequency, which enables the antenna unit 100 to have the effect of dual-frequency antenna resonance. It should be noted that the component specification of each of the above-mentioned components is just an example of the present disclosure and does not intend to limit the scope of the present invention. The abovementioned 2.4 GHz frequency of the antenna unit 100 is actually a frequency band around 2.4 GHz, which is between 2.401 GH and 2.487 GHz in practical applications, and the abovementioned 5 GHz frequency of the antenna unit 100 is actually a frequency band around 5 GHz, which is between 4.980 GHz to 5.828 GHz in practical applications.

The resonance frequency 2.4 GHz substantially depends on the area of the metal component 110, and the resonance frequency 5 GHz substantially depends on the length of the metal component 110 along the straight line L1 (i.e., the total length of the first metal portion M1, the second metal portion M2 and the third metal portion M3 along the straight line L1). By changing the position of the first ground terminal S1 on the semicircle of radius R1 and the second metal portion M2 along the straight line L1, the resonance frequency 2.4 GHz and its impedance matching can be adjusted. By changing the position of the second ground terminal S2 on the semicircle of radius R2 and the third metal portion M3 along the straight line L1, the resonance frequency 5 GHz and its impedance matching can be adjusted.

Figure 3:
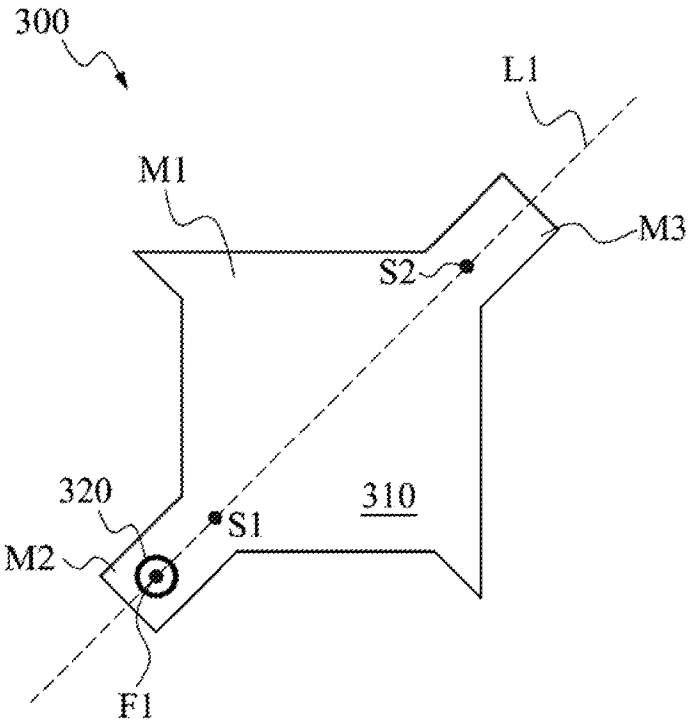
FIG. 3 is a schematic top view of n antenna unit according to another embodiment of this disclosure.

Following the above-mentioned embodiment, wherein the first metal portion M1 is not limited to being similar to a circle or be the combination of semicircles, the first metal portion M1 can be any symmetrical geometrical shape with the straight line L1 as a center line. For example, the first metal portion M1 can be a combination of two triangles. Referring to FIG. 3, FIG. 3 depicts a schematic top view of an antenna unit 300 according to an embodiment of this disclosure.

In FIG. 3, the antenna unit 300 includes a metal component 310 and a loading substrate (not shown). The metal component 310 is disposed on the loading substrate. Another side of the loading substrate has a ground plane (not shown) and a coaxial transmission line (not shown) installed in the loading substrate. The structure can be referred to the embodiments of FIG. 1 and FIG. 2 and will not be described again. The metal component 310 of the antenna unit 300 includes a first metal portion M1, a second metal portion M2 and a third metal portion M3. The second portion M2 includes a feed-in point F1. The first metal portion M1 includes a first ground terminal S1. The second ground terminal S2 is disposed at the third metal portion M3 or on the first metal portion M1 and near the third metal portion M3. A slot structure 320 is disposed surrounding the feed-in point F1. The feed-in point F1, the first ground terminal S1 and the second ground terminal S2 are disposed in a straight line L1. The shape of the metal component 310 is mirror-image symmetrical relative to the straight line L1. In this embodiment, the resonance frequency 2.4 GHz substantially depends on the area of the metal component 310, and the resonance frequency 5 GHz substantially depends on the length of the metal component 310 along the straight line L1 (i.e., the total length of the first metal portion M1, the second metal portion M2 and the third metal portion M3 along the straight line L1).

That is, the metal component of the antenna unit is not limited to including the first metal portion M1 consisting of two semicircles (as shown in FIG. 1), the metal component of the antenna unit can also include the first metal portion M1 consisting of two triangles (as shown in FIG. 3) or of any other symmetrical geometrical shape.

Figure 4:
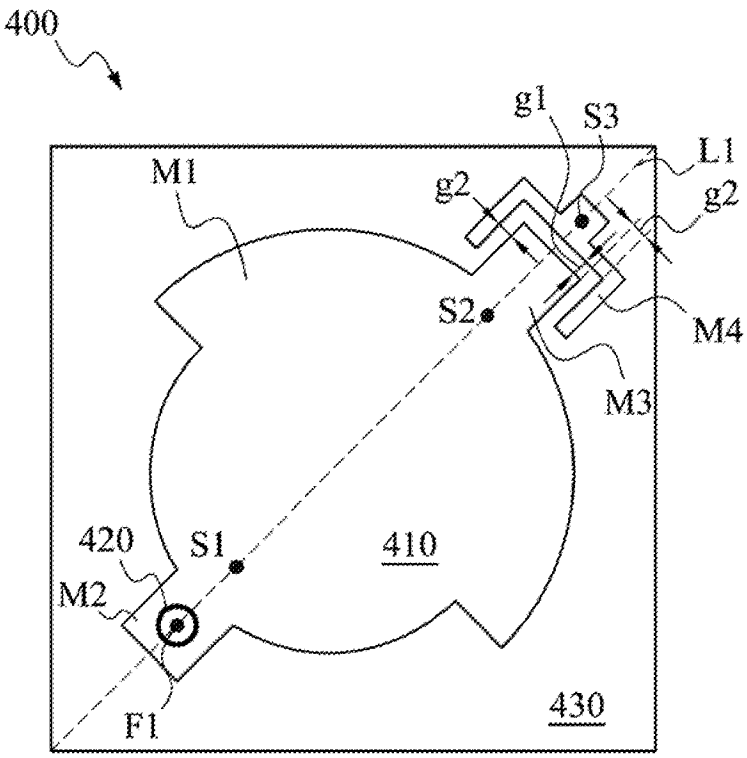
FIG. 4 is a schematic top view of an antenna unit according to another embodiment of this disclosure.

In another embodiment of the present disclosure, the antenna unit can further include a fourth metal portion, as shown in FIG. 4. FIG. 4 depicts a schematic top view of an antenna unit 400 according to an embodiment of this disclosure. The antenna unit 400 includes a metal component 410 and a first substrate 430, wherein the first substrate 430 can be plastic. In addition, the metal component 410 includes a first metal portion M1, a second metal portion M2, a third metal portion M3 and a fourth metal portion M4. Specifically, the second metal portion M2 is connected to one side of the first metal portion M1, and the third metal portion M3 is connected to another side of the first metal portion M1 and opposite to the second metal portion M2. The fourth metal portion M4 and the third metal portion M3 are separated by a gap which is about 0.5 mm-1 mm.

The second metal portion M2 includes a feed-in point F1. The first metal portion M1 includes a first ground terminal S1. A second ground terminal S2 is disposed at the third metal portion M3 or on the first metal portion M1 and near the third metal portion M3. The fourth metal portion M4 includes a third ground terminal S3. A slot structure 420 is disposed surrounding the feed-in point F1. It should be noted that, the feed-in point F1, the first ground terminal S1, the second ground terminal S2 and the third ground terminal S3 are disposed in a straight line L1. The shape of the metal component 410 is mirror-image symmetrical relative to the straight line L1.

The disposition of the fourth metal portion M4 and the third ground terminal S3 can increase the impedance frequency band of the antenna and improve the antenna efficiency and maximum gain. More particularly, the radiation pattern of 2.4 GHz frequency can be converted into directional radiation while the directional radiation of 5 GHz frequency is still maintained.

Figure 5:
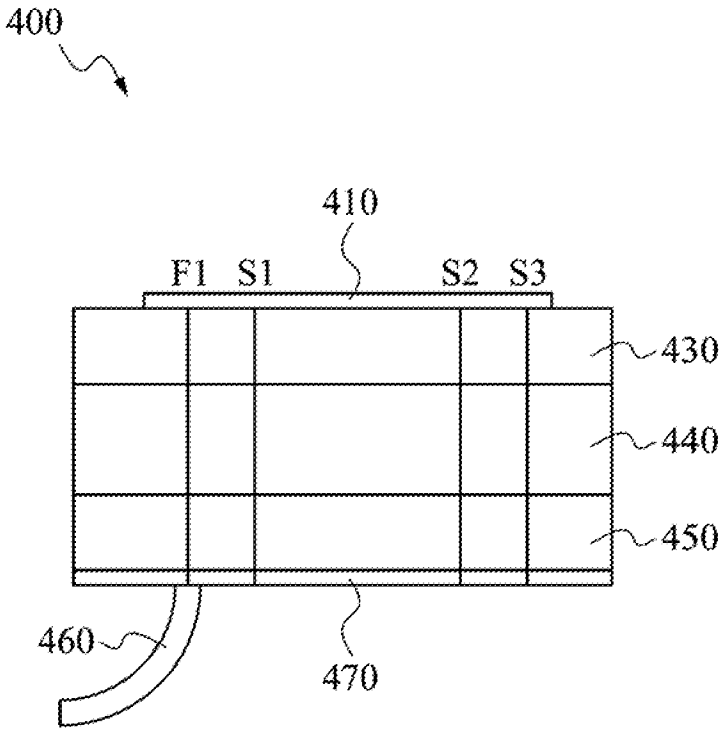
FIG. 5 is a schematic side view of an antenna unit according to another embodiment of this disclosure.

Referring to FIG. 5, FIG. 5 depicts the schematic side view of an antenna unit 400. The antenna unit 400 further includes a second substrate 440 and a third substrate 450. Both the second substrate 440 and the third substrate 450 can be plastic components, wherein the first substrate 430, the second substrate 440 and the third substrate 450 can be three parts of one integrated substrate or be three independent substrates. The bottom of the third substrate 450 has a ground plane 470 attached thereto. A coaxial transmission line 460 includes a positive signal terminal and a negative signal terminal. A feed-in point F1 is electrically coupled to the positive signal terminal of the coaxial transmission line 460 to receive signals. A first ground terminal S1, a second ground terminal S2 and a third ground terminal S3 are electrically coupled to the ground plane 470 so as to be connected to the negative signal terminal of the coaxial transmission line 460.

In one or more embodiments the lengths and widths of the first substrate 430, the second substrate 440, the third substrate 450 are about 35 mm×35 mm, and the thicknesses of them are 0.8 mm, 6.4 mm and 0.8 mm in sequence. That is, the total thickness of the antenna is 8 mm. Because the thickness of the antenna unit increases, the area of the metal component can be narrowed down. In addition, the gaps g1 and g2 between the fourth metal portion M4 and the third metal portion M3 are 0.7 mm and 0.5 mm, respectively.

When the second ground terminal S2 and the first ground terminal S1 are coupled to the ground plane 170 and the third ground terminal S3 is not grounded, the antenna unit 100 will resonate at 2.4 GHz frequency and 5 GHz frequency at the same time wherein the frequency 2.4 GHz is omnidirectional radiation and the frequency 5 GHz is directional radiation. When all of the first ground terminal S1, the second ground terminal S2 and the third ground terminal S3 are coupled to the ground plane 170, both the frequency 2.4 GHz and the frequency 5 GHz are directional radiation. It should be noted that the component specification of each of the above-mentioned component is merely one example of the present disclosure and does not intend to limit the present invention.

In one aspect of the present disclosure, an antenna system is disclosed. The antenna system includes an antenna array. The antenna array consists of a plurality of the aforementioned dual-frequency antenna units, such as the antenna unit 100, the antenna unit 300 the antenna unit 400, and any other antennas without departing from the spirit of the invention.

Figure 6B:
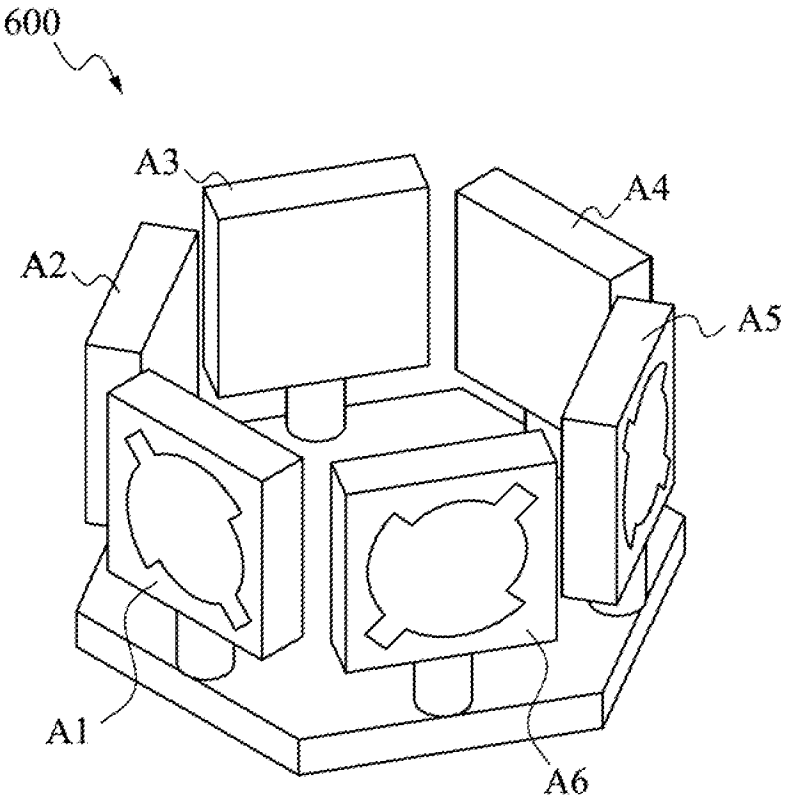
FIG. 6B is a schematic diagram of a structure of an antenna system according to another embodiment of this disclosure.
Figure 6A:
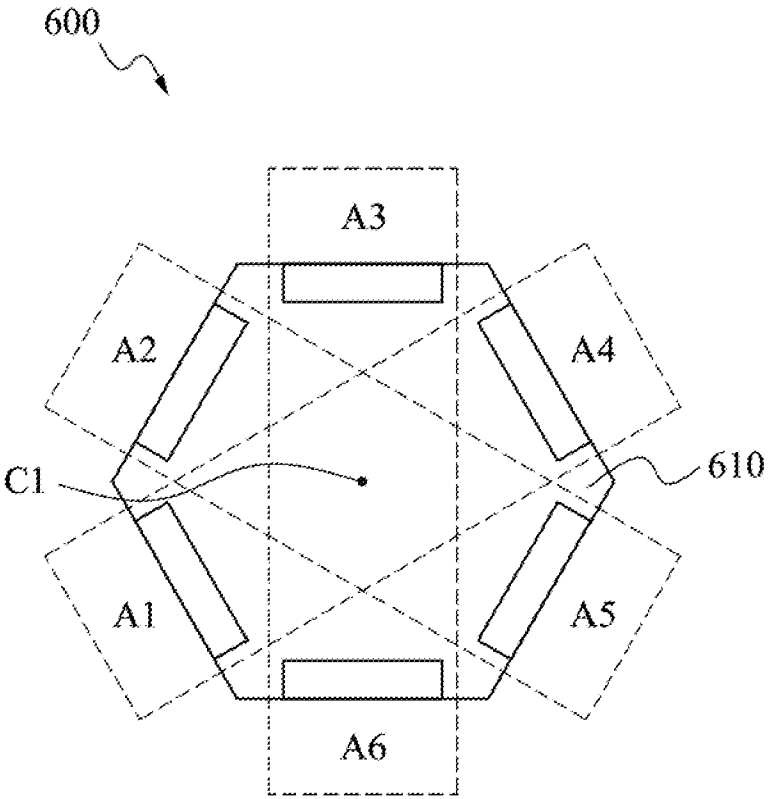
FIG. 6A is a schematic top view of a structure of an antenna system according to an embodiment of this disclosure.

Referring to FIGS. 6A and 6B. FIGS. 6A and 6B respectively depict schematic top view and a schematic diagram of the structure of an antenna, system 600 according to an embodiment of this disclosure. In this embodiment, the antenna system 600 includes a substrate 610, which is used to install six antenna units A1-A6. It should be noted that it is merely one example of the present disclosure, the antenna system 600 can includes less or more antenna units, and the substrate 610 is not necessary to be hexagonal shape as depicted in FIGS. 6A and 6B.

Specifically, the antenna units A1-A6 are disposed around a center C1, and the metal components of the antenna units A1-A6 face outward such that the directional antenna field of each of the antenna units A1-A6 extends outward from the center C1. Each of the antenna units A1-A6 is responsible for a radiation angle of about 60 degrees. Because using patch antennas, the backward radiation of each antenna unit is small and the backward radiation of the antenna system 600 can be lowered, which further reduces the mutual interference between the antenna units.

Figure 7:
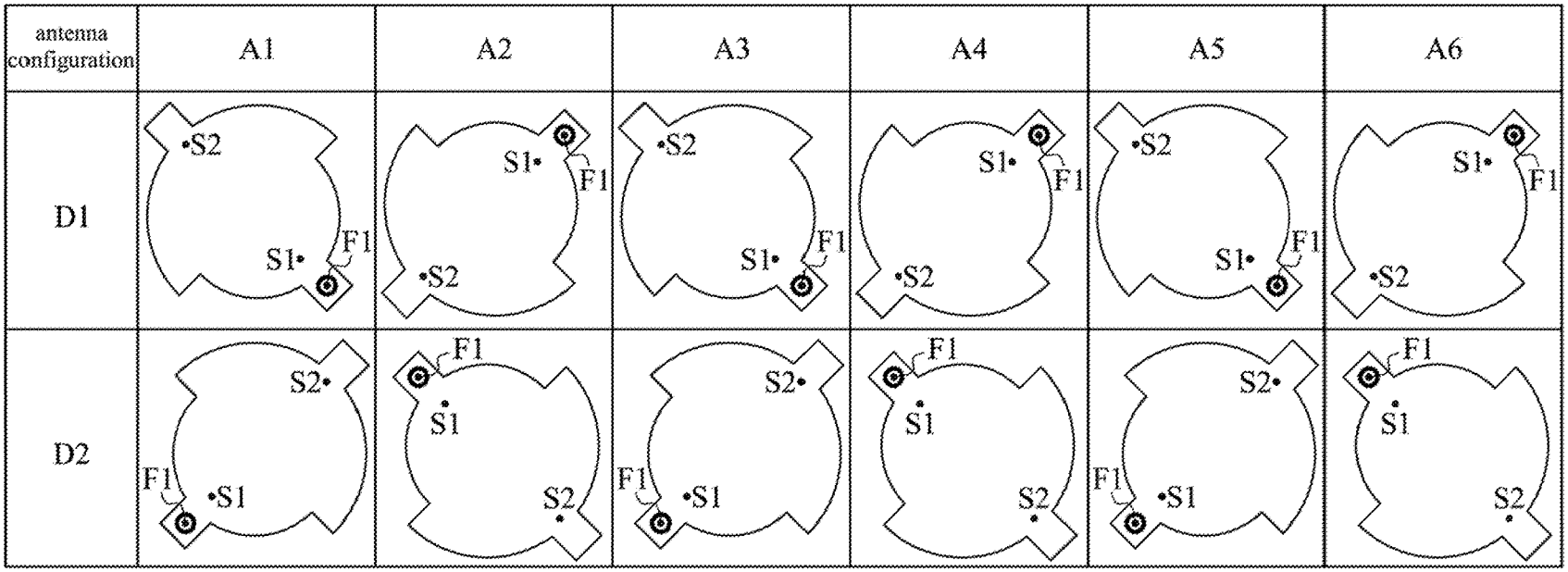
FIG. 7 is an antenna configuration of an antenna system according to an embodiment of this disclosure.

Referring to FIG. 7, FIG. 7 is the antenna configuration of the antenna system 600 according to an embodiment of this disclosure. The antenna units A1-A6 of the antenna system 600 are disposed in a way depicted in the configuration D1 or D2 of FIG. 7. That is, the polarization direction of adjacent antenna units has a difference of 90 degrees. The configuration D1 and the configuration D2 are just part of one example of the present disclosure.

In configuration D1, the polarization direction of any two adjacent antenna units has a difference of 90 degrees. For example, the polarization direction of the antenna unit A1 and the antenna unit A2 has a difference of 90 degrees, the polarization direction of the antenna unit A2 and the antenna unit A3 has a difference of 90 degrees, the polarization direction of the antenna unit A3 and the antenna unit A4 has a difference of 90 degrees, and so on.

For instance, the antenna units A1, A3 and A5 are a group which includes a same polarization direction (e.g., a horizontal polarization direction), and the antenna units A2, A4 and A6 are another group which includes another same polarization direction (e.g., a vertical polarization direction). The antenna units A1, A3 and A5 are respectively responsible for three 120 degrees radiation angles of horizontal polarization directional wireless transceiver signals, and the antenna units A2, A4 and A6 are respectively responsible for three 120 degrees radiation angles of vertical polarization directional wireless transceiver signals.

The configuration of antennas can be any type that has same effect as the present invention does. The above mentioned configuration makes every antenna unit have different polarization direction, so as to make the antenna system 600 have the function of transmitting signals of every polarization direction.

The present disclosure discloses an antenna unit, wherein the antenna unit uses patch antenna structure to improve the directivity and lower the degree of mutual-interference between every antenna. Specifically, the antenna disclosed here is a single patch antenna that can generate two resonant frequencies, which has the characteristic of small size. Generally speaking, the two resonant frequencies are 2.4 GHz and 5 GHz. The 5 GHz frequency generated by the antenna disclosed here has the merits of high directivity, good efficiency and low backward radiation, and the 2.4 GHz frequency generated by the antenna disclosed here has the merits of better omni directivity and broad signal receiving range.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An antenna unit, comprising:

a first metal portion;

a second metal portion connected to one side of the first metal portion;

a third metal portion connected to another side of the first metal portion which is opposite to the second metal portion, wherein the second metal portion and the third metal portion are respectively connected to two protruding portions at two sides of the first metal portion;

a feed-in point disposed at the second metal portion;

a first ground terminal;

a second ground terminal, wherein the feed-in point, the first ground terminal and the second ground terminal are disposed in a straight line, and a shape of the first metal portion is mirror-image symmetrical relative to the feed-in point, the first ground terminal and the second ground terminal;

a fourth metal portion separated from the third metal portion by a gap; and a third ground terminal disposed at the fourth metal portion, wherein the third metal portion and the fourth metal portion are coplanar.

2. The antenna unit of claim 1, wherein the first ground terminal is disposed at the first metal portion, and the second ground terminal is disposed at the third metal portion or on the first metal portion and near the third metal portion.

3. The antenna unit of claim 1, further comprising:

a substrate component including a top surface and a bottom surface, wherein the first metal portion, the second metal portion and the third metal portion are disposed on the top surface; and a ground plane disposed on the bottom surface of substrate component, wherein the first ground terminal and the second ground terminal are electrically coupled to the ground plane respectively.

4. The antenna unit of claim 3, wherein the substrate component comprises a plurality of substrates, the substrates are respectively manufactured by different processes and assembled together to form the substrate component.

5. The antenna unit of claim 4, wherein the substrates are plastic substrates.

6. The antenna unit of claim 3, wherein the substrate component comprises a single dielectric substrate integrally formed in one piece.

7. The antenna unit of claim 1, further comprising:

a slot structure surrounding the feed-in point and used to adjust an impedance matching of the antenna unit.

8. The antenna unit of claim 1, wherein the antenna unit generates a first resonance frequency between the feed-in point and the first ground terminal, the first resonance frequency depends on an area of the antenna unit, the antenna unit generates a second resonance frequency between the feed-in point and the second ground terminal, and the second resonance frequency depends on a length of the antenna unit.

9. The antenna unit of claim 1, wherein the first metal portion includes a first semicircle part and a second semicircle part, and the first semicircle part, the second semicircle part, the second metal portion and the third metal portion are disposed in a straight line.

10. The antenna unit of claim 1, wherein the first metal portion includes a first triangle part and a second triangle part, and the first triangle part, the second triangle part, the second metal portion and the third metal portion are disposed in a straight line.

11. An antenna system, comprising:

an antenna array comprising a plurality of antenna units, wherein each of the antenna units includes a directional antenna field, the antenna units are disposed around a center, and the directional antenna field of each of the antenna units extends outward from the center, wherein each of the antenna units comprises:

a first metal portion;

a second metal portion connected to one side of the first metal portion;

a third metal portion connected to another side of the first metal portion and opposite to the second metal portion, wherein the second metal portion and the third metal portion are respectively connected to two protruding portions at two sides of the first metal portion;

a feed-in point disposed at the second metal portion;

a first ground terminal;

a second ground terminal, wherein the feed-in point, the first ground terminal and the second ground terminal are disposed in a straight line, and a shape of the first metal portion is mirror-image symmetrical relative to the feed-in point, the first ground terminal and the second ground terminal;

a fourth metal portion separated from the third metal portion by a gap; and a third ground terminal disposed at the fourth metal portion, wherein the third metal portion and the fourth metal portion are coplanar.

12. The antenna system of claim 11, wherein a polarization direction between every two adjacent antenna units of the plurality of the antenna units has a difference of 90 degrees.

13. The antenna system of claim 11, wherein the first ground terminal is disposed at the first metal portion, and the second ground terminal is disposed at the third metal portion or on the first metal portion and near the third metal portion.

14. The antenna system of claim 11, wherein each of the antenna units further comprises:

a substrate component including a top surface and a bottom surface, wherein the first metal portion, the second metal portion and the third metal portion are disposed on the top surface; and a ground plane disposed on the bottom surface of substrate component, wherein the first ground terminal and the second ground terminal are electrically coupled to the ground plane respectively.

15. The antenna system of claim 11, wherein each of the antenna units further comprises:

a slot structure surrounding the feed-in point and used to adjust an impedance matching of each of the antenna units.

16. The antenna system of claim 11, wherein each of the antenna units generates a first resonance frequency between the feed-in point and the first ground terminal, the first resonance frequency depends on an area of each of the antenna units, each of the antenna units generates a second resonance frequency between the feed-in point and the second ground terminal, and the second resonance frequency depends on a length of each of the antenna units.

17. The antenna system of claim 11, wherein the first metal portion includes a first semicircle part and a second semicircle part, and the first semicircle part, the second semicircle part, the second metal portion and the third metal portion are disposed in a straight line.

18. The antenna system of claim 11, wherein the first metal portion includes a first triangle part and a second triangle part, and the first triangle part, the second triangle part, the second metal portion and the third metal portion are disposed in a straight line.

* * * * *